US008574138B2

(12) United States Patent
Geotsalitis

(10) Patent No.: US 8,574,138 B2
(45) Date of Patent: Nov. 5, 2013

(54) SLIDABLE EXERCISE APPARATUS

(75) Inventor: Steven P. Geotsalitis, Gurnee, IL (US)

(73) Assignee: Pantelis Innovations, LLC, Gurnee, IL (US)

( * ) Notice: Subject to any disclaimer, the term of this patent is extended or adjusted under 35 U.S.C. 154(b) by 266 days.

(21) Appl. No.: 13/010,836

(22) Filed: Jan. 21, 2011

(65) Prior Publication Data

US 2012/0190516 A1 Jul. 26, 2012

(51) Int. Cl.
*A63B 21/00* (2006.01)

(52) U.S. Cl.
USPC ..... 482/142; 297/423.12; 482/130

(58) Field of Classification Search
USPC ..... 482/51, 71; 297/219.1, DIG. 6, 219.2, 297/219.11
See application file for complete search history.

(56) References Cited

U.S. PATENT DOCUMENTS

| | | | | |
|---|---|---|---|---|
| 4,402,506 | A * | 9/1983 | Jones | 482/70 |
| 4,700,945 | A | 10/1987 | Rader | |
| 4,892,305 | A | 1/1990 | Lynch | |
| 5,713,823 | A | 2/1998 | Walendzak et al. | |
| 6,017,296 | A | 1/2000 | Tang et al. | |
| 6,186,930 | B1 | 2/2001 | Ignaczak | |
| 6,328,680 | B1 | 12/2001 | Shifferaw | |
| 7,070,241 | B2 * | 7/2006 | Saulnier et al. | 297/423.12 |
| 8,016,726 | B2 * | 9/2011 | Abiemo et al. | 482/8 |
| 2007/0004568 | A1 | 1/2007 | Young | |
| 2007/0135280 | A1 | 6/2007 | Hamer | |

* cited by examiner

*Primary Examiner* — Jerome W Donnelly
(74) *Attorney, Agent, or Firm* — Justin Lampel

(57) ABSTRACT

A slidable exercise apparatus includes a pair of platforms, each platform including a base having opposed upper and lower generally planar surfaces and a generally rigid construction. A pad has a lower surface attached to the base upper surface and has a generally cushioned construction. Each platform includes a plurality of skid plates situated on the base lower surface, each skid plate having a smooth outer surface configured to slide on a floor surface.

5 Claims, 6 Drawing Sheets

SLIDABLE EXERCISE APPARATUS

BACKGROUND OF THE INVENTION

This invention relates generally to exercise and fitness equipment and, more particularly, to an exercise apparatus having a pair of padded platforms that are easily slid across a floor surface into position for selected variations of pushup type exercises.

Many consumers are concerned about their personal physical well-being and have a desire to get into better shape or stay in shape. Sometimes, staying in good physical condition is just a desire to look more attractive. Other times, improving one's physical condition is needed to improve a health concern. In any case, taking proactive steps to improve health and wellness takes an internal discipline but also takes obtaining and using the right equipment. If the equipment is inconvenient or too difficult to use, it will be ineffective to produce the desired result.

Some people join a fitness center or buy expensive fitness equipment for their homes, such as treadmills, weight lifting equipment, or video recordings that enable them to follow an exercise instructor. Although assumably effective for their intended uses, joining a fitness club is inconvenient for many people and not feasible for use when traveling. Similarly, many pieces of fitness equipment are complicated, expensive to purchase, and often lead to ineffective results. Further, there are presently no platform exercise devices that may easily be moved around on a floor surface that enable a user to perform variations of pushup type exercises.

Therefore, it would be desirable to have a pair of platforms that may be positioned on the floor and easily moved around to enable multiple types of exercises. Further, it would be desirable to have an exercise apparatus having padded platforms that are comfortable to a user's hands, feet, or knees. In addition, it would be desirable to have an exercise apparatus that is easy to use and portable for travel.

SUMMARY OF THE INVENTION

An exercise apparatus according to the present invention includes a pair of platforms, each platform including a base having opposed upper and lower generally planar surfaces and a generally rigid construction. A pad has a lower surface attached to the base upper surface and has a generally cushioned construction. Each platform includes a plurality of skid plates situated on the base lower surface, each skid plate having an outer surface configured to slide on a floor surface.

Therefore, a general object of this invention is to provide an exercise device that may be slidably positioned on a floor surface to facilitate exercises by a user.

Another object of this invention is to provide an exercise device, as aforesaid, having a pair of platforms each having a rigid base for supporting a user's weight and a cushioned pad for comfortably receiving a user's hands, feet, or knees.

Still another object of this invention is to provide an exercise device, as aforesaid, in which the platforms slide smoothly on a carpeted floor surface.

Yet another object of this invention is to provide an exercise device, as aforesaid, that is portable for storage or travel.

A further object of this invention is to provide an exercise device, as aforesaid, that is easy to use and economical to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
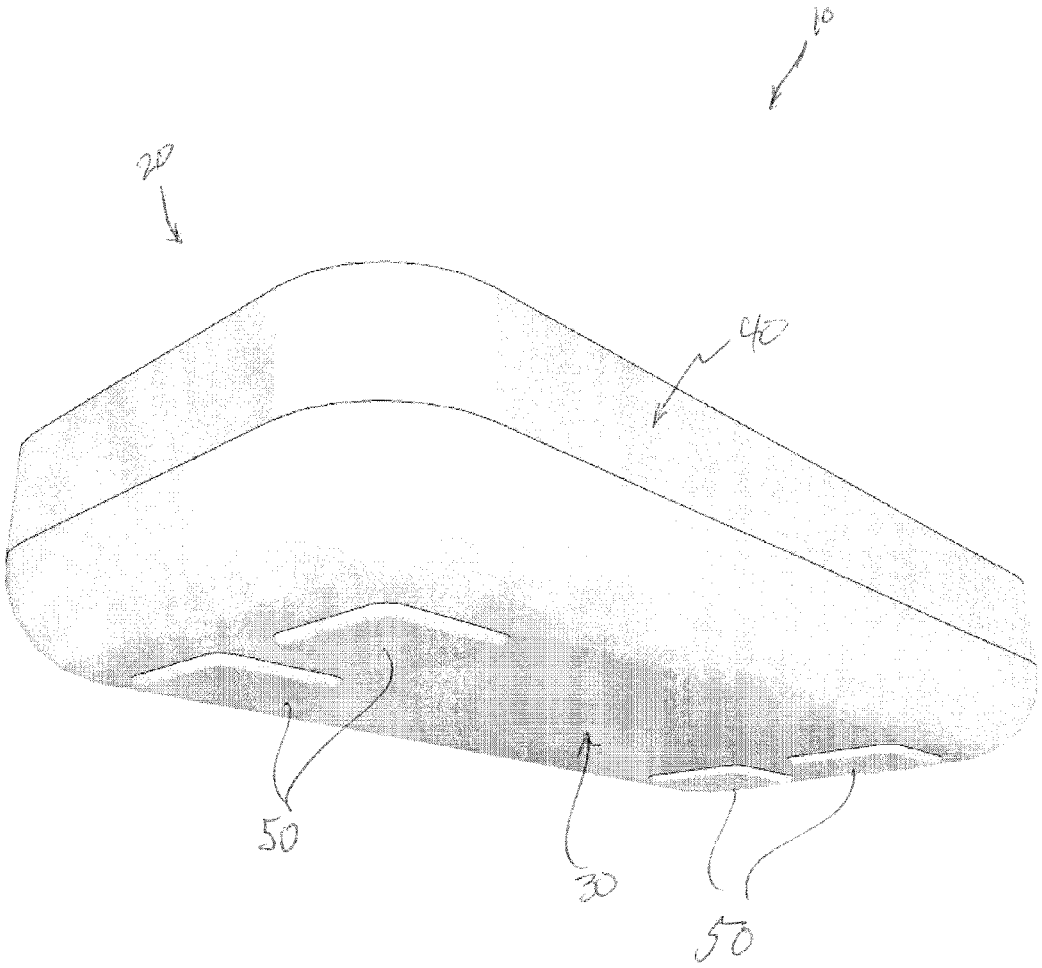
FIG. 1 is a perspective view of a slidable exercise device according to a preferred embodiment of the present invention.
Figure 2:
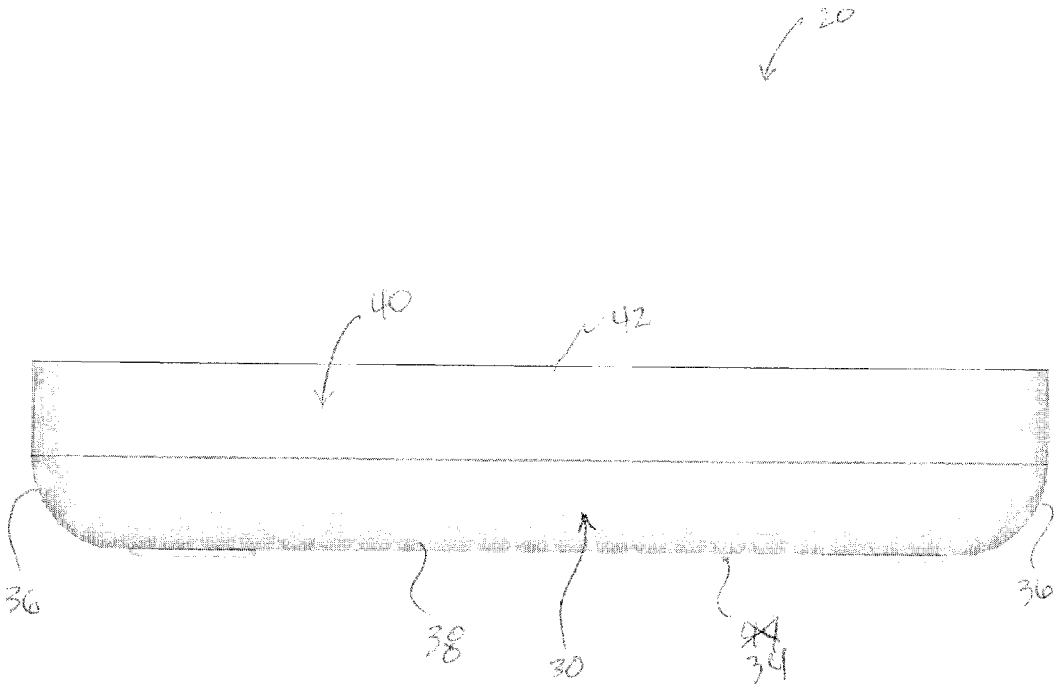
FIG. 2 is a side view of the exercise device as in FIG. 1.
Figure 3:
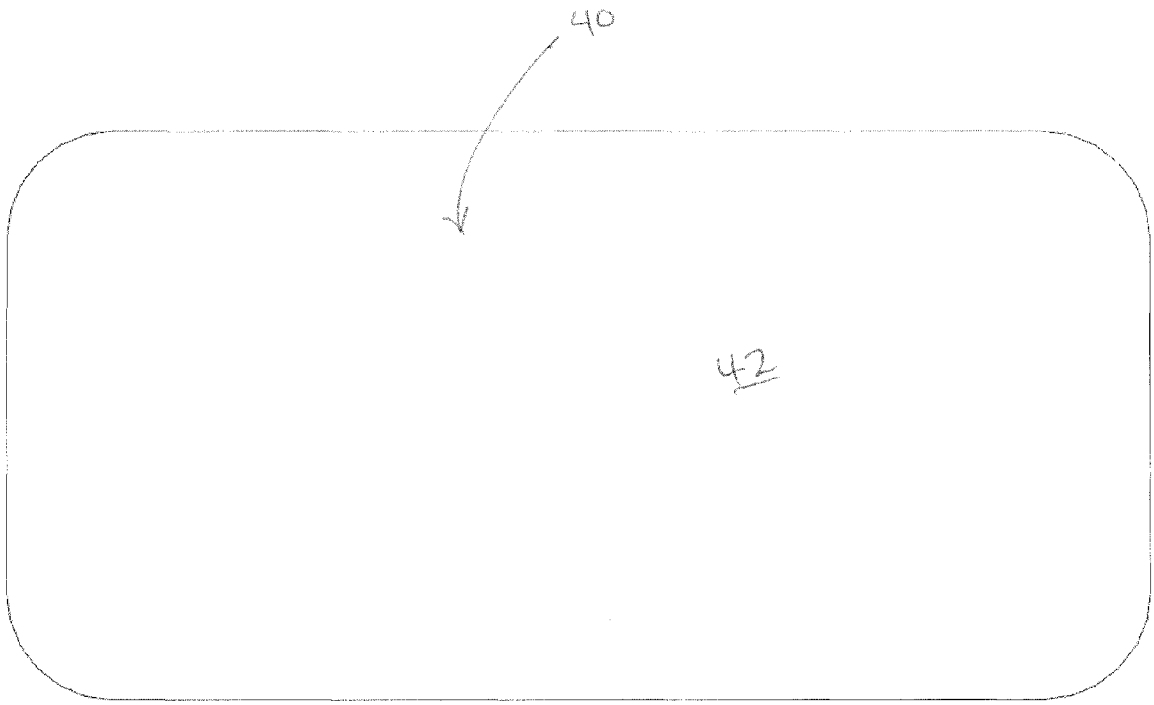
FIG. 3 is a top view of the exercise device as in FIG. 1.
Figure 4:
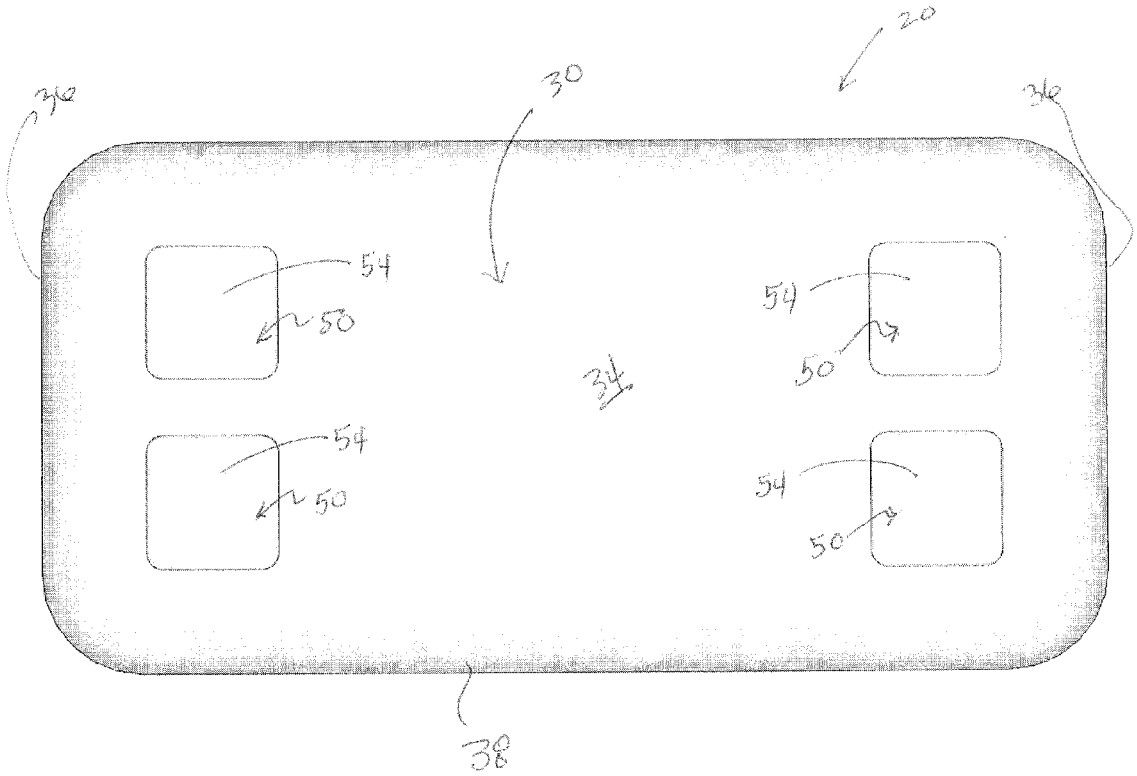
FIG. 4 is a bottom view of the exercise device as in FIG. 1.
Figure 5:
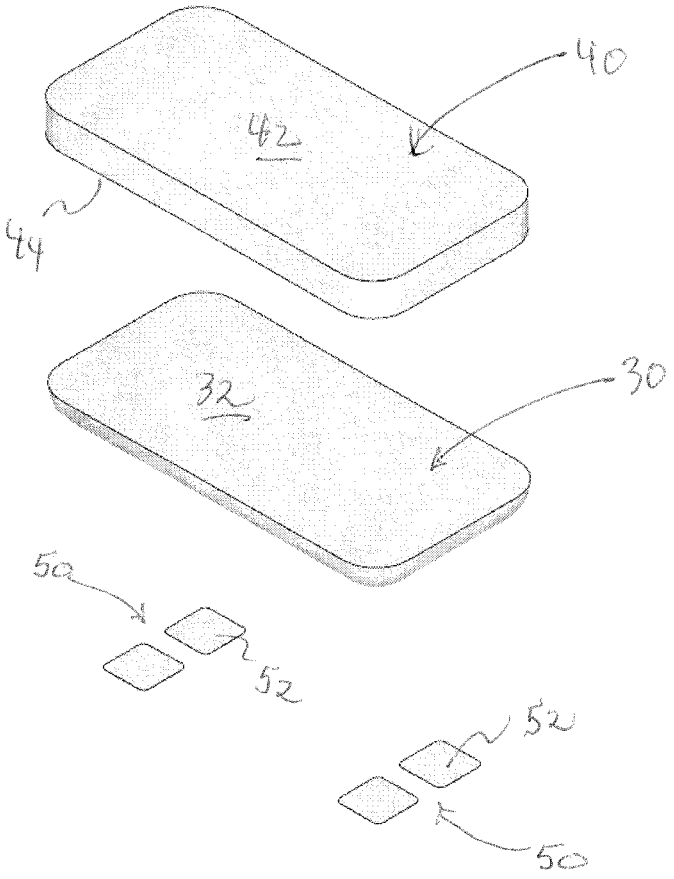
FIG. 5 is an exploded view of the exercise device as in FIG. 1.

An exercise apparatus for use by a person when exercising on a floor surface will now be described in detail with reference to FIGS. 1 to 6*b* of the accompanying drawings. The exercise apparatus 10 includes a base 30, a pad 40, and a plurality of skid plates 50.

Preferably, the exercise apparatus 10 includes a pair of exercise platforms 20. However, the construction of a single platform 20 will be described below as each platform 20 includes substantially the same construction. The platform 20 includes a base 30 having upper 32 and lower 34 generally planar surfaces. Side walls 36 also having a generally planar surface extend between upper 32 and lower 34 surfaces as will be described further later. Preferably, the base side walls 36 are connected to the base lower surface 34 by gently rounded or beveled edges 38. The beveled edges 38 enable the platform 20 to be urged across a carpeted floor surface without snagging or becoming stuck on the edge of the carpet. Similarly, the corners of the base 30 included a rounded configuration. The base 30 may be constructed of a generally rigid material, such as wood, hard plastic, or some other material that will provide a durable base suitable for supporting the weight of a person.

The pad 40 includes opposed upper 42 and lower 44 surfaces. The pad lower surface 44 is attached to the base upper surface 32. The pad 40 is constructed of a cushion material such as foam and is resilient to resume its normal shaped after being pressed upon. The pad 40 includes a peripheral dimension that is substantially similar or complementary to that of the base 30 so as to present a unitary platform having generally smooth and planar side walls for receiving a user's hand thereon.

Figure 6A:
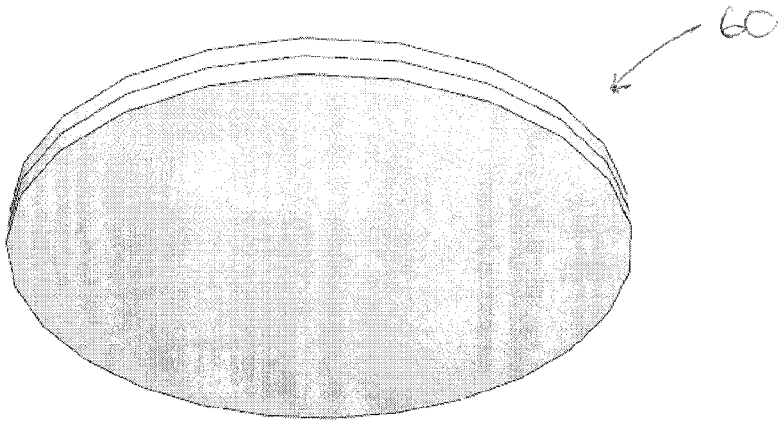
FIG. 6*a* is a perspective view of a slidable exercise device according to another embodiment of the present invention.
Figure 6B:
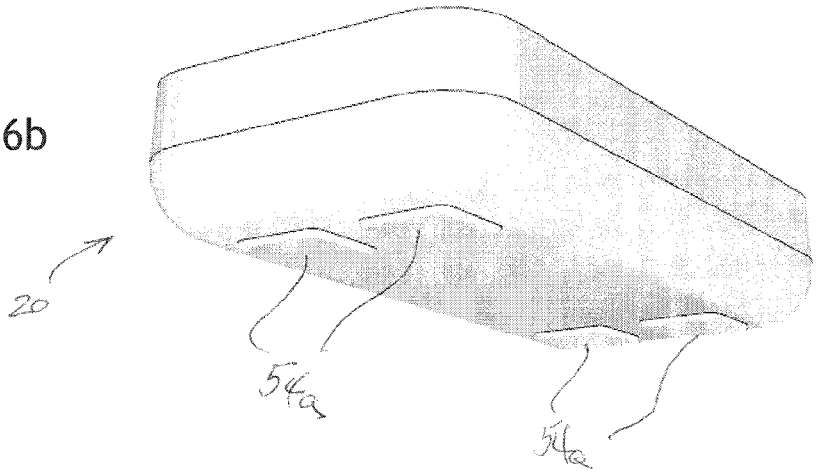
FIG. 6*b* is a perspective view of a slidable exercise device according to still another embodiment of the present invention.

The base 30 and pad 40 define the same shape configuration so as to define generally planar platform side walls. For instance, the platform 20 may include a square or rectangular shape, or may include an oval or circular configuration. An exercise apparatus 60 having a circular configuration is illustrated in FIG. 6*a*. As a normal adult male hand is about 7½×3½", the base 30 and pad 40 preferably have length and width dimensions of about 8"×4". Preferably, the platform 20 includes a height dimension of about 2 inches tall.

The plurality of skid plates 50 are situated on the lower surface of the base 30 and are configured so as to enable the base 30 to be easily moved, slid, scooted, or otherwise urged across a floor surface. The pad, base, and skid plates may be coupled together with adhesive. Each skid plate 50 may include inner 52 and outer 54 surfaces coupled together to define a thin configuration. In other words, a skid plate 50 includes an inward facing surface that is coupled to the lower surface 34 of the base 30 and an outward surface 54 facing outwardly away from the lower surface 34 of the base 30. For use on carpeted floor surfaces, a skid plate outer surface 54 preferably includes a smooth and generally slippery surface. A material having the properties of being durable and slippery is Teflon® although other materials having the preferred characteristics of polytetrafluoroethylene may also be used.

Each of the plurality of skid plates 50 is independent and unconnected to each other skid plate 50. Therefore, the skid plates 50 may be situated in various positions on the lower surface 34 of the base 30. Preferably, the skid plates 50 may be positioned one in each corner of the base lower surface 34 so as to provide slippery surfaces in distributed locations to enhance the ease of urging the pad 40 along a floor surface. Specifically, each skid plate 50 may be spaced apart from any other skid plate 50. However, other configurations would also work, including a partial or complete coverage of the base lower surface 34.

The skid plates 50 may be fixedly attached to the base lower surface 34 or, alternatively, be removably coupled thereto. More particularly, the lower surface 34 of the base 30 may include one of either a hook or loop fastener material such as the product commonly known as Velcro®. An inner surface 52 of each skid plate 50 may then include another of either a hook or loop fastener material complementary to the fastener on the base lower surface 34. Accordingly, the skid plates 50 may be selectively and removably coupled to the base lower surface.

In another variation, the outer surface of each skid pad 40 may include a soft and resilient covering 54*a*. Although a preferred covering material would be felt, other soft materials suitable to slide upon a wood, tile, or laminated floor surface would also work.

In use, a pair of platforms 20 may be positioned on a floor surface for use in personal exercises. The platforms may be used by a user's hands, feet, or knees. For instance, the two platforms 20 may be placed on a carpeted floor surface and urged apart a normal distance for pushups. The user may place his hands on the platforms, respectively, and perform pushups. Similarly, the platforms 20 may be urged to slide on the plurality of skid plates 50 either closer together or further apart to vary the type of pushups. In a similar manner, the exercise apparatus 10 may be moved into position in which the user's feet or knees may be placed thereon for other types of physical exercise. In each case, the pad 40 provides a cushion for a user's hands and the base 30 provides a rigid and stable support. The skid plates 50 enable a user to easily and quickly move each platform to a desired position on the floor. The platforms are also easy to pack in luggage and transported by a user, such as on vacation, business trip, or the like.

It is understood that while certain forms of this invention have been illustrated and described, it is not limited thereto except insofar as such limitations are included in the following claims and allowable functional equivalents thereof.

The invention claimed is:

1. An exercise apparatus for use by a person for exercise on a floor service, comprising: a pair of platforms, each platform including: a base having opposed upper and lower surfaces, said base having a generally rigid construction; a pad having a pad lower surface attached to said base upper surface and a pad upper surface opposite said pad lower surface, said pad having a generally cushioned construction; and a plurality of skid plates situated on said base lower surface, each skid plate having an outer surface configured to slide on the floor surface wherein each of said plurality of skid plates is removably coupled to said base lower surface wherein: said base lower surface includes one of a hook or loop fastener; each of said plurality of skid plates includes an inner surface having another of a hook and loop fastener so that complementary hook and loop fasteners of said base lower surface and a respective skid plate inner surface are selectively attached together.

2. An exercise apparatus for use by a person for exercise on a floor service, comprising: a pair of platforms, each platform including: a base having opposed upper and lower surfaces, said base having a generally rigid construction; a pad having a pad lower surface attached to said base upper surface and a pad upper surface opposite said pad lower surface, said pad having a generally cushioned construction; and a plurality of skid plates situated on said base lower surface, each skid plate having an outer surface configured to slide on the floor surface wherein each of said plurality of skid plates is removably coupled to said base lower surface wherein: said base lower surface includes one of a hook or loop fastener; each of said plurality of skid plates includes an inner surface having another of a hook and loop fastener so that complementary hook and loop fasteners of said base lower surface and a respective skid plate inner surface are selectively attached together; and wherein each said skid plate outer surface includes a soft, resilient covering.

3. An exercise apparatus for use by a person for exercise on a floor service, comprising: a pair of platforms, each platform including: a base having opposed upper and lower generally planar surfaces, said base having a generally rigid construction; a pad having a pad lower surface attached to said base upper surface and a pad upper surface opposite said pad lower surface, said pad having a generally cushioned construction;

wherein said base and said pad have the same shape configuration so as to form planar side walls extending therebetween; a plurality of skid plates situated on said base lower surface, each skid plate having an outer surface configured to slide on the floor surface; and wherein each of said plurality of skid plates is removably coupled to said base lower surface; and wherein: said base lower surface includes one of a hook or loop fastener; each of said plurality of skid plates includes an inner surface having another of a hook and loop fastener so that complementary hook and loop fasteners of said base lower surface and a respective skid plate inner surface are selectively attached together.

4. An exercise apparatus for use by a person for exercise on a floor service, comprising: a pair of platforms, each platform including: a base having opposed upper and lower generally planar surfaces, said base having a generally rigid construction; a pad having a pad lower surface attached to said base upper surface and a pad upper surface opposite said pad lower surface, said pad having a generally cushioned construction;

wherein said base and said pad have the same shape configuration so as to form planar side walls extending therebetween; a plurality of skid plates situated on said base lower surface, each skid plate having an outer surface configured to slide on the floor surface; and wherein each of said plurality of skid plates is removably coupled to said base lower surface; and wherein: said base lower surface includes one of a hook or loop fastener; each of said plurality of skid plates includes an inner surface having another of a hook and loop fastener so that complementary hook and loop fasteners of said base lower surface and a respective skid plate inner surface are selectively attached together; and wherein each said skid plate outer surface includes a soft, resilient covering.

5. An exercise apparatus for use by a person for exercise on a floor service, comprising: a pair of platforms, each platform including: a base having opposed upper and lower generally planar surfaces, said base having a generally rigid construction; a pad having a pad lower surface attached to said base upper surface and a pad upper surface opposite said pad lower surface, said pad having a generally cushioned construction; wherein said base and said pad have the same shape configuration so as to form planar side walls extending therebetween; a plurality of skid plates situated on said base lower surface, each skid plate having an outer surface configured to slide on the floor surface; and wherein each of said plurality of skid plates is removably coupled to said base lower surface; and wherein: said base lower surface includes one of a hook or loop fastener; each of said plurality of skid plates includes an inner surface having another of a hook and loop fastener so that complementary hook and loop fasteners of said base lower surface and a respective skid plate inner surface are selectively attached together; and wherein each said skid plate outer surface includes a soft, resilient covering; and wherein said base includes side walls extending between said base upper surface and said base lower surface, said base side walls and said base lower surface being connected by a beveled edge.

* * * * *